United States Patent [19]

Wier

[11] 4,406,044

[45] Sep. 27, 1983

[54] LOCK FOR SAFETY BELTS

[75] Inventor: Franz Wier, Schwäbisch-Gmünd, Fed. Rep. of Germany

[73] Assignee: Repa Feinstanzwerk GmbH, Alfdorf, Fed. Rep. of Germany

[21] Appl. No.: 231,010

[22] Filed: Feb. 3, 1981

[30] Foreign Application Priority Data

Feb. 5, 1980 [DE] Fed. Rep. of Germany ..... 3004159

[51] Int. Cl.[3] ..... A44B 11/25

[52] U.S. Cl. ..... 24/230 AL

[58] Field of Search ..... 24/230 A, 230 AL, 230 AK

[56] References Cited

U.S. PATENT DOCUMENTS 4,004,115 1/1977 Esner ..... 24/230 AL X 4,181,832 1/1980 Ueda ..... 24/230 AL X 4,237,586 12/1980 Morinaga ..... 24/230 A

*Primary Examiner*—Hugh R. Chamblee

*Attorney, Agent, or Firm*—Herbert L. Lerner; Laurence A. Greenberg

[57] ABSTRACT

Lock for safety belts with a belt lock and an insertion tab which can be detented with a detent edge at a latch which can be moved in the belt lock transversely to the direction of insertion. The latch can be shifted by a pressure organ by hand from the detent position against this force of a spring, as well as with an ejector which is braced resiliently against the detented insertion tab. The ejector is formed by a spring element which can be moved into the shifting path of the latch after the insertion tab is withdrawn, and hold the latch in a position outside the insertion path of the insertion tab.

8 Claims, 15 Drawing Figures

LOCK FOR SAFETY BELTS

BACKGROUND OF THE INVENTION

1. Field of the Invention

The invention relates to a lock for safety belts with a belt lock and an insertion tab which can be detented with a detent edge at a latch which can be moved in the belt lock transversely to the direction of insertion, wherein the latch can be shifted by a pressure organ by hand from the detent position against this force of a spring, as well as with an ejector which is braced resiliently against the detented insertion tab.

2. Description of the Prior Art

In one known lock of this type (German Published Non-Prosecuted Application No. 26 49 559), the insertion tab has a detent cutout for a latch arranged in the lock and the latch is arranged so that it can be moved by hand or, when the insertion tab is inserted, by the latter, from the detent position against the force of a spring. The latch has on its side locking the insertion tab, a bevel leading toward the free end of the latch, following a holding surface extending parallel to its direction of motion, in such manner that due to an opening force exerted on the insertion tab, a latch which is lifted up to the bevel from its locking position, is pushed completely out of the opening or the detent cutout of the insertion tab. It cannot be completely precluded here that in the opening position of the belt lock, the latch with its holding or locking surface again gets partially into the insertion path, which would inhibit the insertion process of the insertion tab. In other known locks of this type, in which the latch has no bevel, the danger of inhibiting the insertion tab motion is still greater. In such devices it is customary to provide an ejector in the lock housing which is designed as a spring-loaded sheet metal part and is braced in the latched position resiliently against the front edge of the insertion tab and blocks the latch elements in the opening position after the insertion tab is ejected. The ejector therefore consists of several elaborate parts, from an assembly and manufacturing point of view, which in addition use up to a considerable extent the space for installation available within the lock housing.

SUMMARY OF THE INVENTION

It is an object of the invention to provide a lock of the type mentioned at the outset that is designwise and assemblywise simple, cost-saving and at the same time a strong design is obtained and the functional and operational reliability is improved over conventional locks.

With the foregoing and other objects in view, there is provided, in accordance with the invention a lock for a safety belt comprising a belt lock having a metallic support with two spaced plates defining an insertion path, an insertion tab attached to a belt for insertion in the insertion path of the metallic support, a latch with a detent edge movable transversely to the direction of insertion of the tab to detent the inserted tab, a pressure organ mounted on the metallic support movable by hand against the force of a spring to move the latch transversely out of the detent position, an ejector formed by a spring element disposed in the insertion path ahead of the tab, and when the tab is detented by the latch, is braced resiliently against the detented insertion tab, said spring element, after the pressure organ has moved the latch out of the detent position, pushing the insertion tab out of the insertion path and following the insertion tab as it moves out from the insertion path, with the spring extending in the path beneath the latch to hold the latch in a position outside the insertion path.

Other features which are considered as characteristic for the invention are set forth in the appended claims.

Although the invention is illustrated and described herein as embodied in a lock for safety belts, it is nevertheless not intended to be limited to the details shown, since various modifications may be made therein without departing from the spirit of the invention and within the scope and range of equivalents of the claims.

BRIEF DESCRIPTION OF THE DRAWINGS

The invention, however, together with additional objects and advantages thereof will be best understood from the following description when read in connection with the accompanying drawings, in which:

In FIG. 1 is illustrated the locked position with the latch extending down into a cutout of the insertion tab thereby preventing its withdrawal. FIG. 2 illustrates an intermediate position in which the coil spring is ejecting the tabs. FIG. 3 shows the lock with the tab withdrawn and with the spring end turns preventing blocking of the insertion path by the latch.

DETAILED DESCRIPTION OF THE INVENTION

Figure 1:
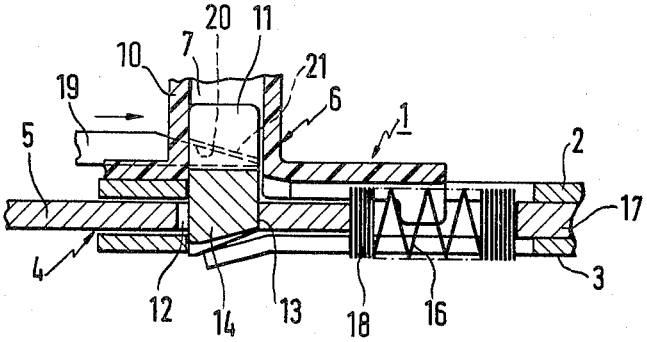
FIGS. 1 to 3 show schematic views of the lock according to the invention for safety belts in different positions of operation.

In accordance with the invention, the ejector is formed by a spring element which can be moved into the shifting path of the latch after the insertion tab is withdrawn, and hold the latch in a position outside the insertion path of the insertion tab. Due to the fact that the ejector is designed as a spring element and in the process assumes the bracing function for the latch as well as the ejector function for the insertion tab, a separate, formed metallic part as in conventional locks for safety belts, is saved, whereby in turn separate guides for this formed part and the like can be dispensed with. One thereby obtains in this manner, in addition to a considerable simplification of the assembly, fewer and simpler parts as well as a saving of the installation space within the housing of the belt lock, together with relatively low weight and small dimensions of the belt lock.

According to further advantageous embodiments of the invention, the spring element can be designed as a coil spring or as a leaf spring or formed spring and the bracing function for the latch is taken over directly by the free spring end or by an extension connected to the spring or the like.

A particularly advantageous further embodiment of the invention is obtained by the features wherein the spring element extends at its free spring end beyond the insertion path of the insertion tab and holds the latch in a position in which it is removed from the insertion path by a safe margin. In this manner it is ensured in any event that the latch is located in the opening position with a margin of safety outside of the insertion path for the insertion tab, so that the insertion of the insertion tab is in no way impeded even in the event of tolerance deviations or in case of gradual wear of the cooperating parts.

At the free end of the latch shank, an incline is provided which is inclined toward the latching edge of the inserted insertion tab and is broken-through by the run-up surface. With respect to the insertion path, the angle of inclination (a) of the incline is larger than that of the run-up surface. The latch has at least one inclined shifting surface against which a manually operable pressure organ is braced over a large surface for carrying out the shifting stroke. Through these features, the latch is designed as a simple-to-produce formed element of extreme strength in such a way that it can fulfill different functions. Thus, the inclined run-up surface forms a centering point for the ejector spring element and at the same time an inclined lifting surface at which the spring element attacks and pushes the latch into the opening position outside the insertion path. The formed element further has inclined surfaces for the preferably large-area and therefore low-pressure engagement of the pressure organ which can be operated by hand, or by the latching edge of the insertion tab.

Further advantageous details of the invention are seen from the embodiment examples which shown in the drawing and will be described in the following.

Figure 2:
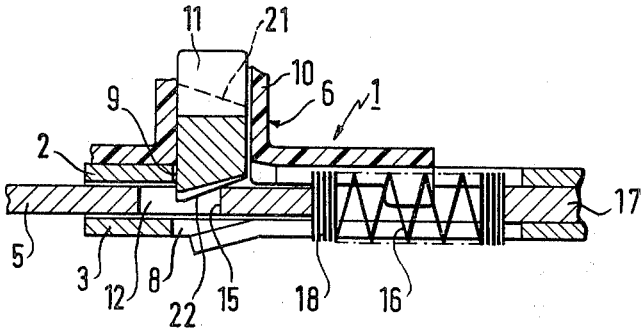
Figure 3:
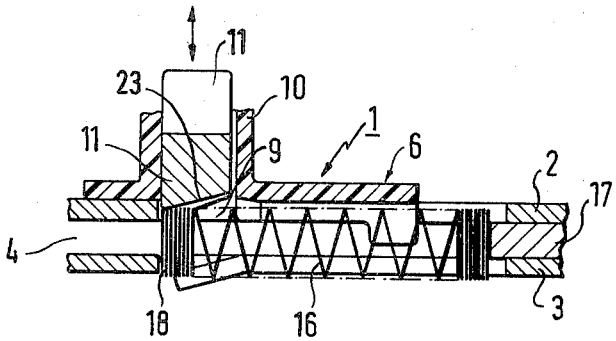

In the lock according to FIGS. 1 to 3, the belt lock 1 has metallic lock support with two plates 2 and 3 which are arranged at a distance from each other, are rigidly connected to each other and define an insertion path 4 for the insertion tab 5. The lock support surrounded by a plastic housing 6 is connected, for instance, via a pull cable to the bottom of a vehicle equipped with the safety belt system while the metallic insertion tab 5 is fastened to the loose end of a belt section which can be wound up in a conventional automatic roll-up device, not shown. A metallic latch 11 is guided movably in the direction of the arrow according to FIG. 3, in a guide 7 of the belt lock 1, perpendicular to the insertion path 4, formed by openings 8, 9 in the plates 2, 3 and by a guide extension 10 of the plastic housing 6. In FIG. 1, the insertion tab 5 and the latch 11 are in the latched or locked position, the latch 11 engaging in a cutout 12 in the insertion tab 5 and coming to a stop with a perpendicular locking surface 13 at the shank 14 of the latch 11 against a locking edge 15 of the cutout 12 of the insertion tab 5. Against this locking surface 13 of this latch 11, the locking edge 15 of the insertion tab 5 is pressed by a spring element representing an ejector in the form of a coil spring 16 which is braced on the one hand against a middle web 17 of the lock support and which has, on the other hand, several closely adjacent spring end turns 18, the last one of which is braced against the insertion tab 5. For opening the lock, a pressure organ 19, which is likewise only shown schematically and is provided with a suitable handle, is shifted according to FIG. 1 in the direction of the arrow so that it runs up with an inclined surface 20 onto a likewise inclined shifting surface 21 of the latch 11, whereby the latch 11 is pushed, as can be seen in FIG. 1, upward into the position according to FIG. 2. The surfaces of the pressure organ 19 and the latch 11 slide on each other on a large area so that high specific pressure at any point is avoided. By this relatively slight shift of the latch 11 in the direction of the opening position, the boundary of the latching edge 15 at the top of FIG. 2, of the insertion tab 5 comes in contact with a bevel 22 which is, likewise, designed in the form of an inclined surface, whereby the latch 11 is shifted completely into the opening position according to FIG. 3 by the force of the spring element 16. During this shifting motion, the end turn of the spring 18 of the spring element 16 comes again into contact with a likewise inclined run-up surface 23 along which they slide up to the position shown in FIG. 3, in which the latch 11 is completely in a position outside of the insertion path 4 for the insertion tab 5. As can be seen from FIGS. 1 and 3, the spring element 16 is designed so that it extends at least at its free spring end over the insertion path 4 and holds the latch 11 in an opening position in which it is removed from the insertion path 4 by a margin of safety. The closely spaced spring end turns 18 prevent the latch 11 which is substantially tapered in wedge-fashion, moving again into the vicinity of the insertion path 4, where it could impede the insertion of the insertion tab 5.

Figure 4:
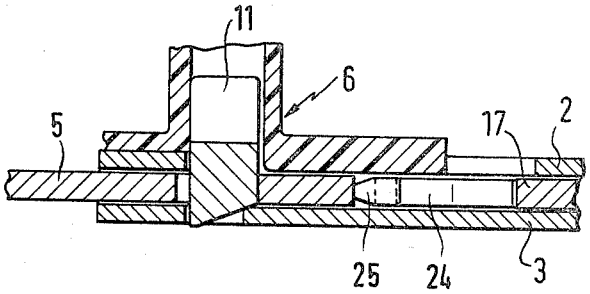
FIGS. 4 to 6 illustrate another embodiment of the lock according to the invention in different positions of operation, and in particular, show the use of a formed spring as the ejector.
Figure 5:
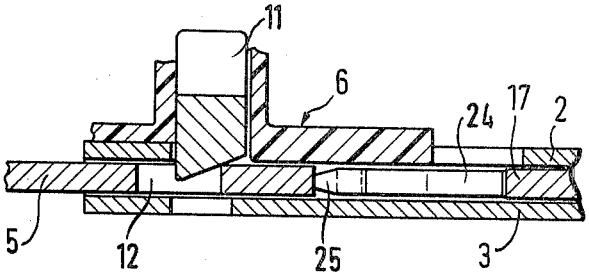
Figure 6:
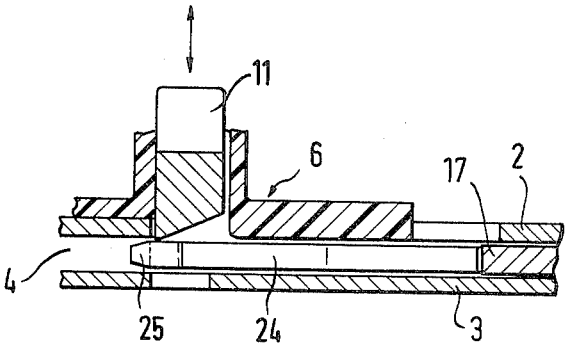
Figure 7:
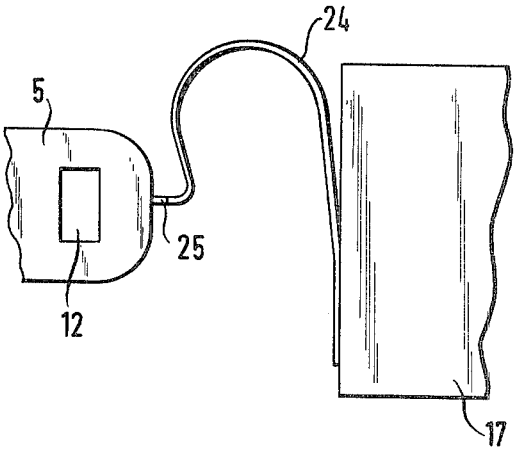
FIG. 7 shows in greater detail the formed spring of the lock according to FIGS. 4 to 6.
Figure 8:
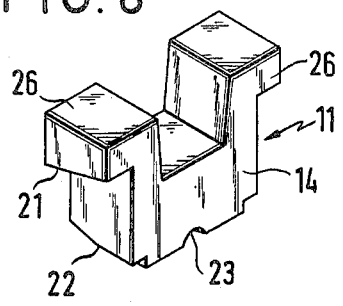
FIGS. 8 to 11 show another embodiment of the lock according to the invention with particular reference to use of T-shaped latch with an inclined surface at its lower free end for a run-up surface.
Figure 9:
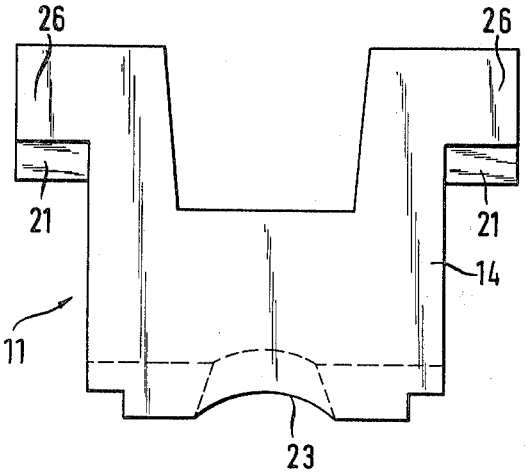
Figure 10:
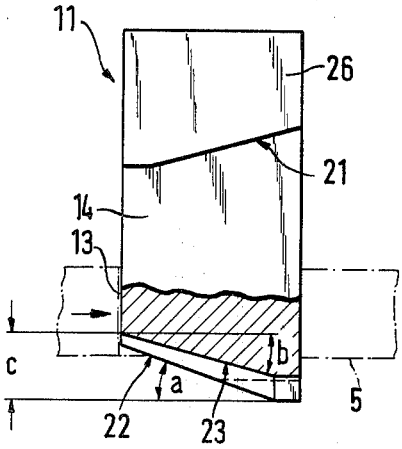
Figure 11:
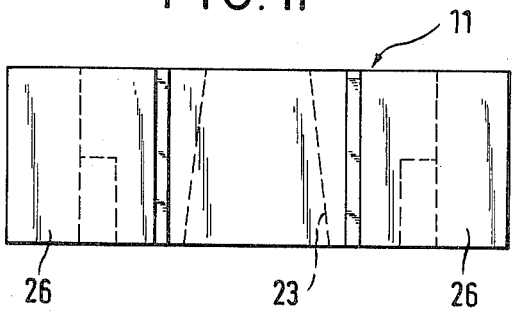
Figure 12:
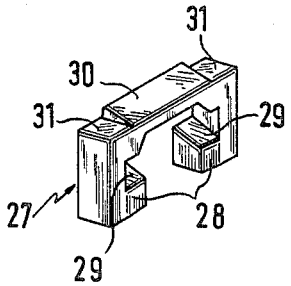
FIGS. 12 to 15 show a second embodiment example of a latch which can be used in the lock according to the invention, in a perspective view from different directions of view.
Figure 13:
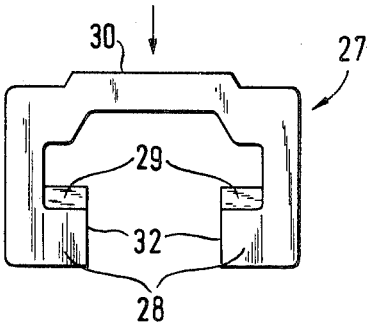
Figure 14:
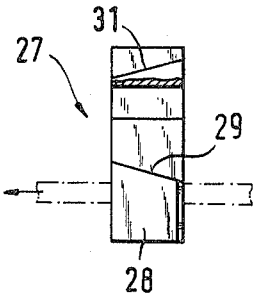
Figure 15:
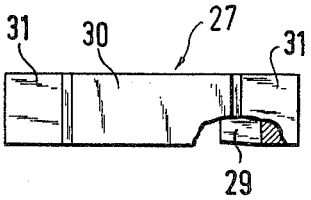

The lock according to FIGS. 4, 5, 6 and 7 is of the same design, with the exception of a detail, as the lock according to FIGS. 1 to 3, so that a complete description need not be repeated. The difference essentially is that the spring element is not a helical or coil spring 16 but the formed spring 24. Formed spring 24 is braced, as shown particularly in FIG. 7, with a rearward-bent spring end against the middle web 17 of the lock support, and has on the other hand a support extension 25 which is axially angled off from the insertion path 4, is tapered in wedge-fashion toward the end and is braced in the latching position against the insertion tab 5 (FIG. 4). If the latch 11 is lifted by means of the pressure organ 19, the latch 11 is first moved by the insertion tab 5 and thereupon by the support extension 25 into the opening position according to FIG. 6 and is held there. The wedge-shaped inclination of the support extension 25 facilitates making contact between the form spring 24 and the latch 11. The latch 11 used in the lock according to FIGS. 1 to 7 is shown as a detail in FIGS. 8 to 11. The latch 11, as a formed element is of one piece in substantially T-shaped form. Latch 11 has the mentioned lock-like latch shank 14 at which two lateral extensions 26 are formed at the top, as shown in the FIGS. 8–10. The extensions 26 have at their lower side the already mentioned inclined shifting surfaces 21. Similarly, the pressure organ 19, indicated only schematically in FIG. 1, is designed in the form of a fork with two fork tines. The two fork tines have inclined surfaces 20 which come into contact with the shifting surfaces 21. At the lower boundary of the shaft shank 14 (FIGS. 8–11), the bevel 22 is formed which is broken-through by the run-up surface 23 in the center of the area. This run-up surface 23 is made in the form of a concave dome as shown particularly in FIGS. 8 and 9. The angle of inclination a of the incline 22 with respect to the insertion path 4 is larger than the angle of inclination of b of the run-up surface 23, as shown in FIG. 10. This run-up surface 23 forms a centering device for the ejector designed as a spring element according to FIGS. 1 and 3. Indicated dash-dotted in FIG. 10 is the insertion tab 5, the withdrawal direction of which is indicated by an arrow. The distance c between the beginning and the end of the inclines 22/23 is here the measure of the opening excursion which is executed by the insertion tab 5 and the spring element on the latch, so that only the initial residual stroke needs to be supplied by the pressure organ 19 (FIG. 1) at the beginning of the opening process. By means of FIGS. 12–15, a latch 27 of different design in illustrated. This latch is substantially of C-shape, inclinations 29 being formed onto the free ends 28 facing each other, while at the middle or non-free connection section 30, two shifting surfaces 31 are arranged at both ends of this connecting section. Contrary to the embodiment example according to the preceding Figures, the latch 27 is moved here in the Figures not upward but rather downward in the direction of the arrow according to FIG. 13 by letting inclined surfaces of a fork-like pressure organ run onto the shifting surfaces 31, whereupon the locking surfaces 32 of the latch 27 lose contact with the locking edges of the insertion tab. Similar to the preceding embodiment example, the latch 27 is then pushed, as the insertion tab runs onto the inclines 29, completely down until it is outside of the insertion path for the insertion tab, and is blocked in the operating position by an ejector which is preferably designed in the form of a spring element.

I claim:

1. Lock for a safety belt comprising a belt lock having a metallic support with two spaced plates defining an insertion path, an insertion tab attached to a belt for insertion in the insertion path of the metallic support, a latch with a detent edge movable transversely to the direction of insertion of the tab to detent the insertion tab, a pressure organ mounted on the metallic support movable by hand against the force of a spring to move the latch transversely out of the detent position, and ejector formed by a spring element disposed in the insertion path ahead of the tab, and when the tab is detented by the latch, is braced resiliently against the detented insertion tab, said spring element, after the pressure organ has moved the latch out of the detent position, pushing the insertion tab out of the insertion path and following the insertion tab as it moves out from the insertion path, with the spring extending in the path beneath the latch to hold the latch in a position outside the inertion path, and wherein the spring element extends at its free spring end beyond the insertion path of the insertion tab and holds the latch in a position in which it is safely removed from the insertion path.

2. Lock according to claim 1, wherein said spring element is a coil spring with closely spaced spring end turns which end turn extends in the path beneath the latch to hold the latch in a position outside the insertion path.

3. Lock according to claim 1, wherein the spring element is designed as a formed or leaf spring.

4. Lock according to claim 1, wherein the latch is of substantially C-shaped design and has at the free ends facing each other bevels for the insertion tab and at the non-free connecting section at least one shifting surface for a pressure organ.

5. Lock according to claim 1, wherein the latch is designed as a shaped element with block-like shaft shank having an incline which is located in the center of the transverse path of the latch, and wherein said block has in its cross section a concave run-up surface for the ejector.

6. Lock according to claim 5, wherein the latch shank at its free end has an incline which is inclined toward a latching edge of the inserted insertion tab and which incline is broken-through by said run-up surface.

7. Lock according to claim 6, wherein with respect to the insertion path, the angle of inclination of the incline is larger than that of the run-up surface.

8. Lock according to claim 5 or claim 6 or claim 7, wherein the latch has at least one inclined shifting surface against which a manually operable pressure organ is braced over a large surface for carrying out the shifting stroke.

* * * * *